US010102832B2

(12) United States Patent
Gonzalez

(10) Patent No.: US 10,102,832 B2
(45) **Date of Patent: *Oct. 16, 2018**

(54) UNIVERSAL TUNING KNOB FOR STRINGED INSTRUMENTS

(71) Applicant: Gregory Manuel Gonzalez, Los Angeles, CA (US)

(72) Inventor: Gregory Manuel Gonzalez, Los Angeles, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/360,621

(22) Filed: Nov. 23, 2016

(65) Prior Publication Data

US 2017/0236500 A1 Aug. 17, 2017

Related U.S. Application Data

(63) Continuation-in-part of application No. 15/042,007, filed on Feb. 11, 2016, now Pat. No. 9,620,091.

(51) Int. Cl.
*G10D 3/14* (2006.01)

(52) U.S. Cl.
CPC ..... *G10D 3/14* (2013.01)

(58) Field of Classification Search
CPC ..... G10D 3/14
USPC ..... 84/304–306
See application file for complete search history.

(56) References Cited

U.S. PATENT DOCUMENTS

| | | | | |
|---|---|---|---|---|
| 3,154,327 | A * | 10/1964 | Rothschild | F16L 37/144 285/189 |
| 4,098,163 | A * | 7/1978 | Kato | G10D 3/14 84/306 |
| 4,515,059 | A * | 5/1985 | Siminoff | G10D 3/14 84/306 |
| 5,463,924 | A * | 11/1995 | Reuterfors | G10D 3/14 84/304 |
| 5,998,713 | A * | 12/1999 | Herin | G10D 3/14 84/304 |
| 6,706,956 | B1 * | 3/2004 | Gotoh | G10D 3/14 84/304 |
| 7,973,225 | B2 * | 7/2011 | Goto | G10D 3/14 84/304 |
| 8,247,673 | B1 * | 8/2012 | Reboul | G10D 3/14 84/304 |

* cited by examiner

*Primary Examiner* — Jianchun Qin
(74) *Attorney, Agent, or Firm* — Cotman IP Law Gorup, PLC

(57) ABSTRACT

A universal tuning knob for stringed instruments is presented. The invention consists of a knob with an elongated and threaded cylindrical shaft. The shaft includes a lumen sized to receive the machine head post of any stringed instrument. The outside perimeter of the knob is configured for grip. The threaded cylindrical shaft includes a slot on its side wall to receive and retain a bushing. The bushing includes a second slot that can be notched (i.e. sized) to fit and lock the machine head post of any stringed instrument. A sleeve lock with internal threads is threaded onto the threaded cylindrical shaft of the knob thereby retaining the bushing. An optional second lumen on the head of the knob is configured to receive a mounting screw.

8 Claims, 6 Drawing Sheets

UNIVERSAL TUNING KNOB FOR STRINGED INSTRUMENTS

CROSS-REFERENCE TO RELATED APPLICATIONS

The present application is a Continuation-in-Part of U.S. patent application Ser. No. 15/042,007, filed on Feb. 11, 2016, now U.S. Pat. No. 9,620,091, specification of which is herein incorporated by reference for completeness of disclosure.

BACKGROUND OF THE INVENTION

Field of the Invention

Embodiments of the invention relates to the field of musical instruments. More specifically, the invention relates to a universal tuning knob for stringed instruments.

Description of the Related Art

Stringed instruments such as guitars, banjos, and similar instruments require tuning to produce the desired sound. A stringed instrument has a plurality of strings connected with string posts having central axes disposed in a single plane which extends perpendicular to a head portion of the instrument. Stringed instruments include configurations with the string posts divided on opposite sides of the head portion of the instrument, configurations with the string posts on one side of the head portion of the instrument, etc. A string tuning device is connected with each of the strings. The string tuning device is operable to tension the string of the musical instrument to obtain a desired tension or pitch. Special effects can be obtained during the playing of a stringed instrument by varying the tension of one or more of the strings.

The problem with current tuning devices is that each is custom made for a specific stringed instrument making replacement difficult because of the potential wait time in getting new devices from the manufacturer. This wait time basically renders the stringed instrument useless during this replacement period.

To overcome the problems and limitations described above there is a need for a universal tuning knob for stringed instruments.

BRIEF SUMMARY OF THE INVENTION

One or more embodiments of the invention are directed a universal tuning knob for stringed instruments. One or more embodiments of the present invention comprise a knob with a head section at its proximal end and an elongated threaded cylindrical shaft at its distal end. The shaft includes a lumen configured to receive a machine head post of a stringed instrument. The head section comprises an outside perimeter configured for grip. The head section optionally includes a lumen configured to receive a mounting screw. The threaded cylindrical shaft includes a slot on its side wall for receiving and retaining a bushing.

One or more embodiments of the present invention further comprise a semi-cylindrical bushing configured to fit inside the slot on the threaded cylindrical shaft of the knob. The bushing includes a second slot that is sized to fit and lock the machine head post of a stringed instrument thereby preventing the machine head post from freely rotating.

One or more embodiments of the present invention further comprise a sleeve lock with internal threads. The sleeve lock threads onto the threaded cylindrical shaft of the knob to enclose and retain the bushing.

BRIEF DESCRIPTION OF THE DRAWINGS

The above and other aspects, features and advantages of the invention will be more apparent from the following more particular description thereof, presented in conjunction with the following drawings wherein.

DETAILED DESCRIPTION

The present invention comprising a universal tuning knob for stringed instruments will now be described. In the following exemplary description numerous specific details are set forth in order to provide a more thorough understanding of embodiments of the invention. It will be apparent, however, to an artisan of ordinary skill that the present invention may be practiced without incorporating all aspects of the specific details described herein. Furthermore, although steps or processes are set forth in an exemplary order to provide an understanding of one or more systems and methods, the exemplary order is not meant to be limiting. One of ordinary skill in the art would recognize that the steps or processes may be performed in a different order, and that one or more steps or processes may be performed simultaneously or in multiple process flows without departing from the spirit or the scope of the invention. In other instances, specific features, quantities, or measurements well known to those of ordinary skill in the art have not been described in detail so as not to obscure the invention. It should be noted that although examples of the invention are set forth herein, the claims, and the full scope of any equivalents, are what define the metes and bounds of the invention.

For a better understanding of the disclosed embodiment, its operating advantages, and the specified object attained by its uses, reference should be made to the accompanying drawings and descriptive matter in which there are illustrated exemplary disclosed embodiments. The disclosed embodiments are not intended to be limited to the specific forms set forth herein. It is understood that various omissions and substitutions of equivalents are contemplated as circumstances may suggest or render expedient, but these are intended to cover the application or implementation.

The term "first", "second" and the like, herein do not denote any order, quantity or importance, but rather are used to distinguish one element from another, and the terms "a" and "an" herein do not denote a limitation of quantity, but rather denote the presence of at least one of the referenced item.

One or more embodiments of the present invention will now be described with references to FIGS. 1-7. As illustrated, one or more embodiments of the universal tuning knob system 10 of the present invention comprises is knob (or bolt) 20; a bushing 30; and a sleeve 40.

Each tuning knob system 10 is manually rotatable to rotate the machine head post 52 about its central axes thereby adjusting tension in the corresponding string of the stringed instrument.

Figure 4C:
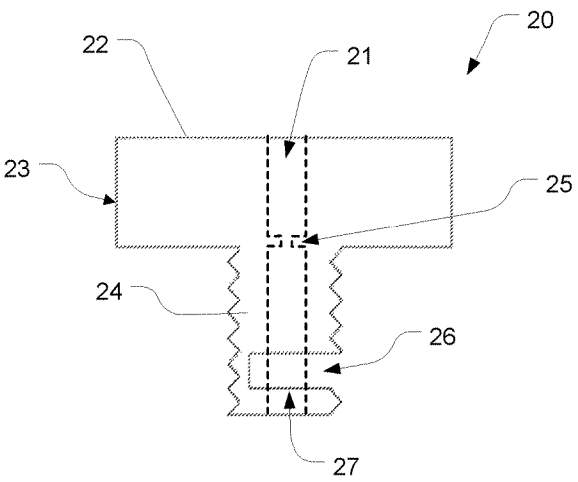
FIG. 4C is an illustration of a side plan view of the knob 20 of the universal tuning knob system in accordance with one or more embodiments of the present invention.
Figure 4D:
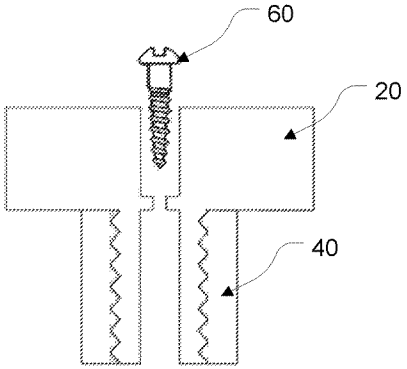
FIG. 4D is an illustration of a cross-sectional view of the universal tuning knob system with a mounting screw in accordance with one or more embodiments of the present invention.
Figure 4B:
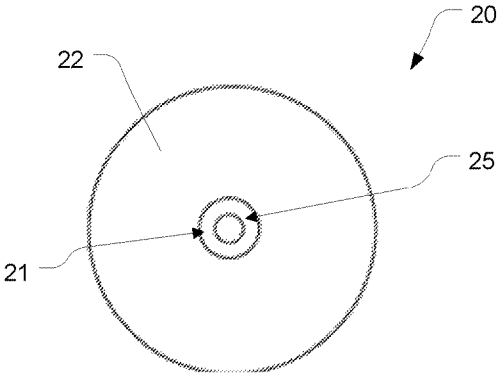
FIG. 4B is an illustration of a top view of the knob 20 of the universal tuning knob system in accordance with one or more embodiments of the present invention.
Figure 4A:
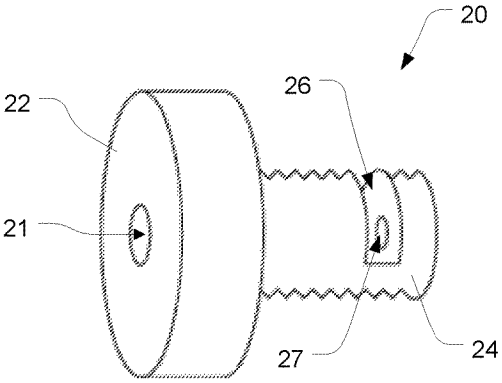
FIG. 4A is an illustration of a perspective view of a knob 20 of the universal tuning knob system in accordance with one or more embodiments of the present invention.
Figure 6B:
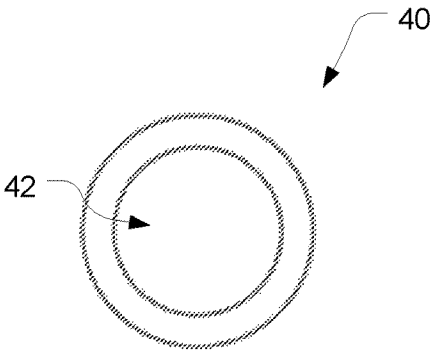
FIG. 6B is an illustration of a top view of the sleeve 40 of the universal tuning knob system in accordance with one or more embodiments of the present invention.
Figure 6A:
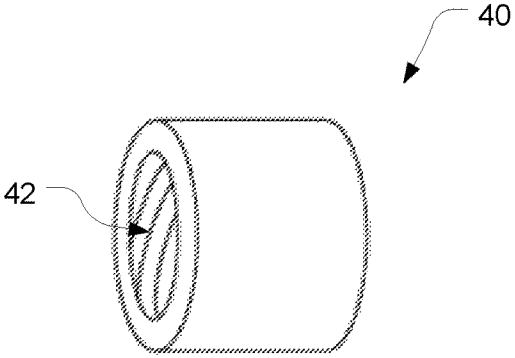
FIG. 6A is an illustration of a perspective view of a sleeve 40 of the universal tuning knob system in accordance with one or more embodiments of the present invention.
Figure 5B:
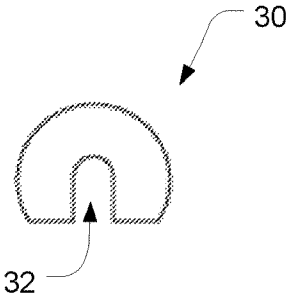
FIG. 5B is an illustration of a top view of the bushing 30 of the universal tuning knob system in accordance with one or more embodiments of the present invention.
Figure 5A:
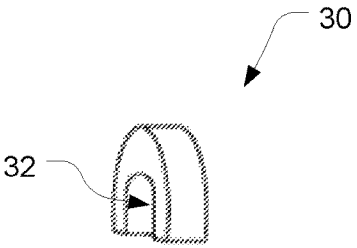
FIG. 5A is an illustration of a perspective view of a bushing 30 of the universal tuning knob system in accordance with one or more embodiments of the present invention.
Figure 7C:
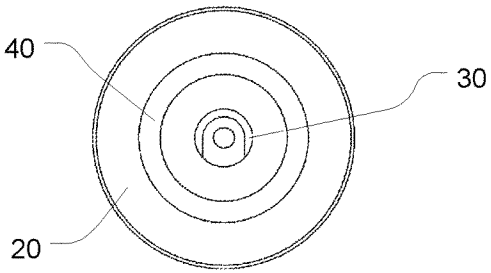
FIG. 7C is a bottom view of the configuration of FIG. 7A fully assembled with a patterned grip for the knob of the universal tuning knob system in accordance with one or more embodiments of the present invention.
Figure 7D:
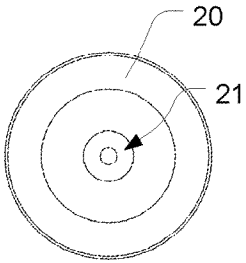
FIG. 7D is a top view of the configuration of FIG. 7A fully assembled with a patterned grip for the knob of the universal tuning knob system in accordance with one or more embodiments of the present invention.
Figure 7A:
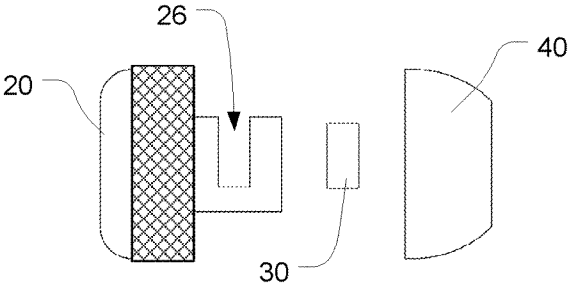
FIG. 7A is an exploded view of a configuration with a patterned grip for the knob of the universal tuning knob system in accordance with one or more embodiments of the present invention.
Figure 7B:
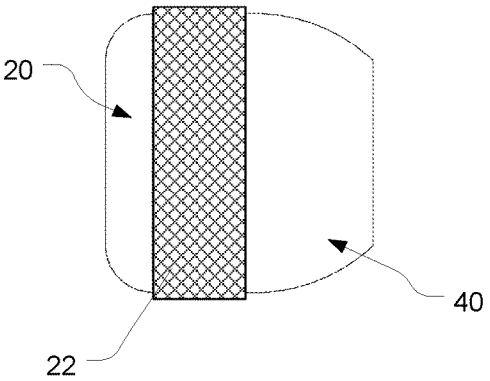
FIG. 7B is a side plan view of the configuration of FIG. 7A fully assembled with a patterned grip for the knob of the universal tuning knob system in accordance with one or more embodiments of the present invention.

In one or more embodiments, the knob 20 comprises a head section 22 and a shaft section 24. The head section 22 may optionally include a lumen 21 for receiving mounting screw 60 (FIG. 4D). The head section 22 may be provided in any desired configuration and groove pattern. For instance, the head section 22 may be round with smooth (as illustrated in FIG. 4A) or polished side surface 23. Head section 22 is preferably configured in a non-slip configuration with a grip and side surface adequate for manual tuning, e.g., with patterned grooves as illustrated in FIGS. 7A-D. Those of skill in the arts would appreciate that other configurations of the head section are contemplated and that disclosure of particular embodiments is not intended to be limiting. For instance, the grip or head section could be cylindrical, boxed, lateral, flipped cylindrical, spherical, etc.

Knob 20 includes a cylindrical shaft 24 which is integrally formed as one piece with the head section 22 at its proximal end. The shaft 24 is threaded on its outside surface and includes a slot 26 on its side wall, towards its distal end. Shaft 24 further includes a lumen 27 through its central axis for receiving gear post 52 of a machine head 50 of a stringed instrument. Lumen 27 is preferably configured large enough to receive the machine head posts of most, if not all, stringed instruments. In one or more embodiments, lumen 27 runs the length of the shaft 24, i.e. from distal end to the proximal end.

In one or more embodiments, knob 20 further includes a neck portion 25 abutting lumen 21 and lumen 27.

Slot 26 of the shaft is configured to receive and retain bushing 30. As illustrated in FIG. 4A, slot 26 traverses the lumen 27. In one or more embodiments, bushing 30 is a semi-cylindrical shaped device with a slot 32. In a preferred embodiment, slot 32 of bushing 30 is configured (i.e. notched) for an exact fit for a specific machine head post 52. Thus, as the size of the gear head post varies depending on the make, model, and type of stringed instruments, all that needs to change is selecting a bushing with the correct size and shape for slot 32.

Figure 1:
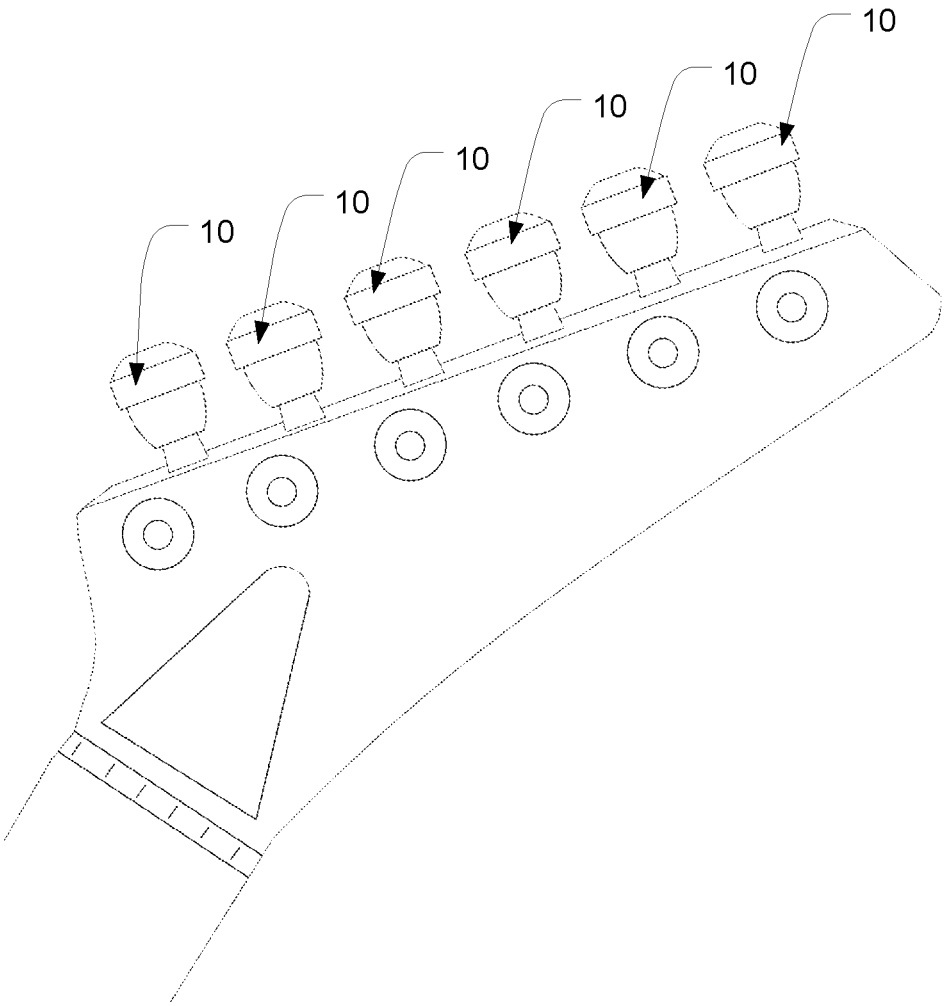
FIG. 1 is an illustration of the rear side view of the head of a stringed instrument with six universal tuning knob systems 10 in accordance with an embodiment of the present invention.
Figure 2:
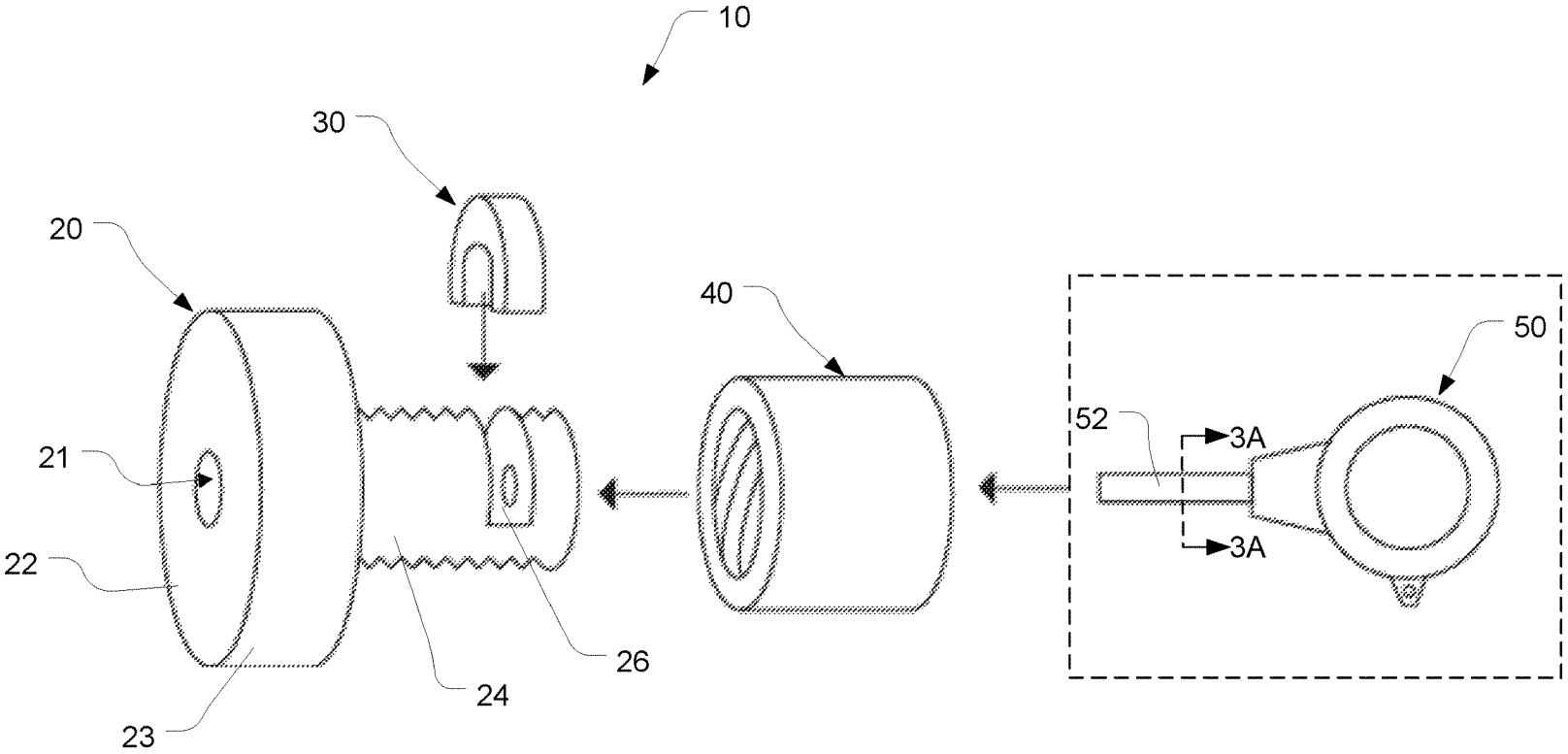
FIG. 2 is an illustration of an exploded view of the universal tuning knob system 10 in accordance with one or more embodiments of the present invention.
Figure 3A:
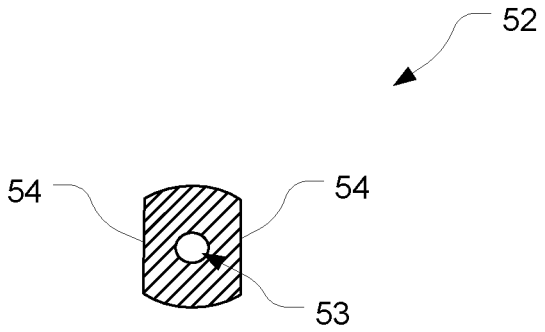
FIG. 3A is a cross-sectional view of section 3A of a typical machine head post.

As illustrated in FIG. 3A, a typical machine head gear post is oval in cross-section with opposing parallel straight sides 54. This cross-sectional shape of the gear post is universal, but the overall size may vary, depending on the make, model, and type of stringed instruments. The hole 53 is configured to hold screw 60.

Figure 3B:
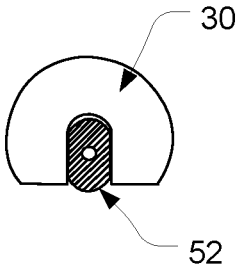
FIG. 3B is an illustration of how the machine head gear post sits in the slot of the bushing of the present invention in a fit and lock position.

In one or more embodiments, sleeve lock 40 is cylindrical and comprises a circular and threaded inside lumen 42. Lumen 42 threads over cylindrical shaft 24 to enclose and retain the bushing 30 inside slot 26 of the universal tuning knob system 10. When inside slot 26, bushing 30 fits onto and locks the gear post 52, which is in lumen 27, by hugging the parallel sides 54 thereby preventing the gear post from freely rotating inside the slot 32, as illustrated in FIG. 3B. That is, the slot 32 of the bushing is configured to snugly fit and hold the sides 54 of the gear post 52 to prevent free rotational movement of the gear post.

While the invention herein disclosed has been described by means of specific embodiments and applications thereof, numerous modifications and variations could be made thereto by those skilled in the art without departing from the scope of the invention set forth in the claims.

What is claimed is:

1. A universal tuning knob for stringed instruments comprising:

a knob with a head section at its proximal end and an elongated and integrally formed threaded shaft at its distal end, said shaft comprising a lumen configured to receive a machine head post of a stringed instrument, wherein the head section comprises an outside perimeter configured for grip and the threaded shaft includes a first slot on its distal end;

a bushing configured to fit inside said first slot on said threaded shaft, wherein said bushing includes a second slot configured to fit and lock the machine head post of the stringed instrument; and a sleeve lock with internal threads removably threaded onto the threaded shaft of the knob thereby retaining said bushing.

2. The universal tuning knob of claim 1, wherein said head section further comprises a lumen for receiving a mounting screw.

3. The universal tuning knob of claim 1, wherein said bushing is semi-cylindrical.

4. The universal tuning knob of claim 1, wherein said head section is circular with a smooth outside surface.

5. The universal tuning knob of claim 1, wherein said head section is circular with a patterned groove outside surface.

6. A universal tuning knob for stringed instruments comprising:

a knob with a head section at its proximal end and an elongated threaded cylindrical shaft at its distal end, wherein said shaft includes a lumen configured to receive a machine head post of a stringed instrument, wherein the head section comprises an outside perimeter configured for grip and a second lumen configured to receive a mounting screw, and wherein the threaded cylindrical shaft includes a first slot on its side wall;

a bushing configured to fit inside said first slot on said threaded cylindrical shaft, wherein said bushing includes a second slot configured to fit and lock the machine head post of a stringed instrument; and a sleeve lock with internal threads removably threaded onto the threaded cylindrical shaft of the knob thereby retaining said bushing.

7. The universal tuning knob of claim 6, wherein said bushing is semi-cylindrical.

8. A universal tuning knob for stringed instruments comprising:

a knob with a head section at its proximal end and an elongated threaded cylindrical shaft at its distal end, wherein said shaft includes a lumen configured to receive a machine head post of a stringed instrument, and wherein the threaded cylindrical shaft includes a first slot on its side wall that traverses the lumen;

a bushing configured to fit inside said first slot on said threaded cylindrical shaft, wherein said bushing includes a second slot configured to fit and lock the machine head post of a stringed instrument; and a sleeve lock with internal threads removably threaded onto the threaded cylindrical shaft of the knob thereby retaining said bushing.

* * * * *